US008768238B2

(12) United States Patent
Kimura et al.

(10) Patent No.: US 8,768,238 B2
(45) Date of Patent: Jul. 1, 2014

(54) IMAGE FORMING APPARATUS WHICH CONTROLS A SUBSEQUENT SHEET TO BE DISCHARGED AT A SAME SPEED AS A PREVIOUS SHEET

(75) Inventors: Kuniyasu Kimura, Toride (JP); Yuichiro Maeda, Kashiwa (JP); Takuya Hayakawa, Toride (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 368 days.

(21) Appl. No.: 12/727,072

(22) Filed: Mar. 18, 2010

(65) Prior Publication Data

US 2010/0239296 A1 Sep. 23, 2010

(30) Foreign Application Priority Data

Mar. 19, 2009 (JP) ..... 2009-067904

(51) Int. Cl.

| | |
|---|---|
| ***G03G 15/00*** | (2006.01) |
| ***G03G 15/23*** | (2006.01) |
| ***B65H 29/58*** | (2006.01) |
| ***B65H 39/10*** | (2006.01) |
| ***B65H 51/30*** | (2006.01) |

(52) U.S. Cl.

CPC ..... *G03G 15/234* (2013.01); *B65H 29/58* (2013.01); *B65H 39/10* (2013.01); *B65H 51/30* (2013.01)

USPC ..... 399/405; 399/401; 399/407; 271/186

(58) Field of Classification Search

CPC ..... G03G 15/234; G03G 15/6573; G03G 2215/00945; G03G 2215/00949; G03G 15/23; G03G 2215/00426; B65H 29/58; B65H 39/10; B65H 2301/4312; B65H 2301/438; B65H 2801/27; B65H 51/30

USPC ..... 399/401, 405, 407; 271/902, 184, 185, 271/186

See application file for complete search history.

(56) References Cited

U.S. PATENT DOCUMENTS

| | | | | |
|---|---|---|---|---|
| 6,139,012 | A | 10/2000 | Furuya | |
| 7,263,328 | B2 * | 8/2007 | Asai et al. | 399/408 |
| 8,301,073 | B2 * | 10/2012 | Ueda et al. | 399/401 |
| 2006/0269339 | A1 * | 11/2006 | Okamoto et al. | 399/401 |

FOREIGN PATENT DOCUMENTS

| | | | | |
|---|---|---|---|---|
| CN | 101398645 A | | 4/2009 | |
| JP | 06-161185 A | | 6/1994 | |
| JP | 2000-177902A A | | 6/2000 | |
| JP | 2000177902 | * | 6/2000 | B65H 29/22 |

* cited by examiner

*Primary Examiner* — Daniel J Colilla
*Assistant Examiner* — Blake A Tankersley
(74) *Attorney, Agent, or Firm* — Canon USA, Inc., IP Division

(57) ABSTRACT

An image forming apparatus connected to a conveying-speed-changeable sheet post processing device includes a discharging unit which discharges a sheet in a reverse discharge mode with front and back surfaces of the image-formed sheet reversed, and a non-reverse discharge mode without front and back surfaces of the image-formed sheet reversed, and discharges the sheet at a first speed or a second speed lower than the first speed; and a control unit which controls the discharging unit to discharge the sheet at the first speed in the reverse discharge mode and at the second speed in the non-reverse discharge mode. When the sheet is discharged at the second speed, the control unit controls the discharging unit to discharge a subsequent sheet at the second speed even if the subsequent sheet is to be discharged in the reverse discharge mode.

11 Claims, 11 Drawing Sheets

FIG. 6

| PAGE | JOB A | JOB B | JOB C |
|---|---|---|---|
| 1 | A4 DUPLEX (FRONT SURFACE) | A4 ONE-SIDE | A4 ONE-SIDE |
| 2 | A4 DUPLEX (BACK SURFACE) | A4 DUPLEX (FRONT SURFACE) | A3 DUPLEX (FRONT SURFACE) |
| 3 | A4 ONE-SIDE | A4 DUPLEX (BACK SURFACE) | A3 DUPLEX (BACK SURFACE) |
| 4 | A4 DUPLEX (FRONT SURFACE) | A4 ONE-SIDE | A4 ONE-SIDE |
| 5 | A4 DUPLEX (BACK SURFACE) | A4 DUPLEX (FRONT SURFACE) | A4 DUPLEX (FRONT SURFACE) |
| 6 | A4 ONE-SIDE | A4 DUPLEX (BACK SURFACE) | A4 DUPLEX (BACK SURFACE) |

PRIOR ART

IMAGE FORMING APPARATUS WHICH CONTROLS A SUBSEQUENT SHEET TO BE DISCHARGED AT A SAME SPEED AS A PREVIOUS SHEET

BACKGROUND OF THE INVENTION

1. Field of the Invention

The present invention relates to an image forming apparatus connected to a sheet post processing device that carries out post processing for a sheet with an image formed thereon, and is configured to discharge the sheet at one of a plurality of discharging speeds.

2. Description of the Related Art

When a digital multifunction apparatus is used as a printer, data is typically printed in order beginning with the first page. For example, to print five pages, the pages are printed in order of the first page, second page, third page, fourth page, and fifth page. To stack the output sheets on a discharge tray in the correct order, each sheet has to be discharged with an image-formed surface facing the lower side. Accordingly, the image forming apparatus has a sheet reversing mechanism that reverses the front and back surfaces of a sheet.

The sheet reversing mechanism uses a switchback system in which a sheet is led to a reverse conveying path diverging from a straight discharge conveying path, then the sheet conveying direction of the sheet is changed, and the sheet is conveyed. In this case, to prevent continuously conveyed sheets from colliding with one another in the reverse conveying path, at least a sheet interval for a switchback distance is required. In order to increase productivity by decreasing the sheet interval, Japanese Patent Laid-Open No. 6-161185 describes control that increases a speed of a sheet from start of reversing a sheet until discharge of the sheet from an image forming apparatus body. A discharging speed when a sheet is discharged in reverse manner is different from a discharging speed when a sheet is discharged in non-reverse manner.

Further, when the discharging speed is changed, a conveying speed of a sheet post processing device that receives a sheet discharged from the image forming apparatus has to be changed in accordance with the discharging speed of the image forming apparatus body.

For example, if the discharging speed of the apparatus body is higher than the receiving speed of the sheet post processing device, a sheet may be pushed in an area between the sheet post processing device and the image forming apparatus, resulting in the sheet not be conveyed in an ordinary way.

In contrast, if the receiving speed of the sheet post processing device is higher than the discharging speed of the apparatus body, the following restrictions may be conceived. If the conveying speed of a sheet is changed while a toner image is transferred on the sheet or fixed to the sheet, changing of the speed may adversely affect image formation. Thus, the speed should not be changed during this period. In particular, if a distance relationship is established such that the leading edge of a sheet reaches the sheet post processing device although the trailing edge of the sheet has not passed through a fixing unit, the receiving speed of the sheet post processing device should not be higher than the discharging speed of the apparatus body.

Also, U.S. Pat. No. 6,139,012 describes a configuration that includes a conveying path having a distance relationship such that the leading edge of a sheet reaches a sheet post processing device after the trailing edge of the sheet has passed through a fixing unit. In this case, even if the conveying speed of the sheet post processing device is different from that of the image forming apparatus, a sheet is pulled out while the sheet slips on rollers of the image forming apparatus. Thus, the sheet can be delivered.

However, in the '012 Patent, immediately after an image is fixed to the sheet, the sheet is conveyed in a slipping manner. Implementation of this arrangement makes assuring quality of an image difficult.

Therefore, it is necessary to control the conveying speed of the sheet post processing device and the discharging speed of the image forming apparatus body so as to be at substantially equivalent speeds.

In the field of commercial printing, a set of printed sheets may include a sheet with an image formed on only one surface and a sheet with images formed on both surfaces.

FIG. 11 illustrates a discharging operation of related art in a case in which a sheet with an image formed on only one surface and a sheet with images formed on both surfaces are mixed. For example, in an image forming apparatus that discharges a sheet in reverse manner at 1000 mm/s and discharges a sheet in non-reverse manner during duplex printing at 500 mm/s, image formation is carried out in order of one-side printing (reverse discharge), duplex printing (non-reverse discharge), one-side printing (reverse discharge), and then duplex printing (non-reverse discharge). In this case, the conveying speed of the sheet post processing device has to be changed when discharge is changed from reverse discharge to non-reverse discharge, and when discharge is changed from non-reverse discharge to reverse discharge.

However, to change the speed in a short time, a costly motor having a large torque is required. Such a motor increasing the cost of the sheet post processing device.

Also, if a plurality of sheet post processing devices are connected, a sheet interval has to be large to allow a sheet post processing device, which requires the longest time for changing the speed, to change the speed. This significantly decreases productivity.

Thus, if one-side printing and duplex printing are alternately carried out as shown in FIG. 11, the sheet interval will be large every time a sheet is discharged due to the time needed to change the speed required by the sheet post processing device.

If all sheets including sheets for one-side printing are printed by duplex printing, the speed does not have to be changed in the sheet post processing device. However, if the proportion of sheets for one-side printing is large, productivity is decreased because the sheets are conveyed through a path for duplex printing.

SUMMARY OF THE INVENTION

The present invention provides an image forming apparatus in which the above described disadvantages are addressed.

The present invention provides an image forming apparatus that reduces decrease in productivity due to changing sheet conveying speed without increasing the cost even when a sheet to be discharged in reverse manner and a sheet to be discharged in non-reverse manner are mixed.

According to an aspect of the present invention, an image forming apparatus is connected to a sheet post processing device capable of changing a conveying speed when the sheet post processing device receives a sheet. The image forming apparatus includes a discharging unit configured to discharge a sheet in one of a reverse discharge mode and a non-reverse discharge mode, wherein in the reverse discharge mode the sheet is discharged to the sheet post processing device after image formation with front and back surfaces of the sheet reversed and in the non-reverse discharge mode the sheet is discharged to the sheet post processing device after image formation without front and back surfaces of the sheet reversed. The discharging unit is configured to discharge the sheet to the sheet post processing device at one of a first speed and a second speed which is lower than the first speed. A control unit is configured to control the discharging unit to discharge the sheet at the first speed when the sheet is to be discharged in the reverse discharge mode and to discharge the sheet at the second speed when the sheet is to be discharged in the non-reverse discharge mode. When a previous sheet, discharged immediately before the sheet, is discharged at the first speed, the control unit controls the discharging unit to discharge the sheet at the first speed even if the sheet is to be discharged in the non-reverse discharge mode.

Further features of the present invention will become apparent from the following description of exemplary embodiments with reference to the attached drawings.

BRIEF DESCRIPTION OF THE DRAWINGS

FIG. 6 illustrates exemplary jobs for image formation.

DESCRIPTION OF THE EMBODIMENTS

Embodiments of the present invention will be described below with reference to the attached drawings.

Figure 1:
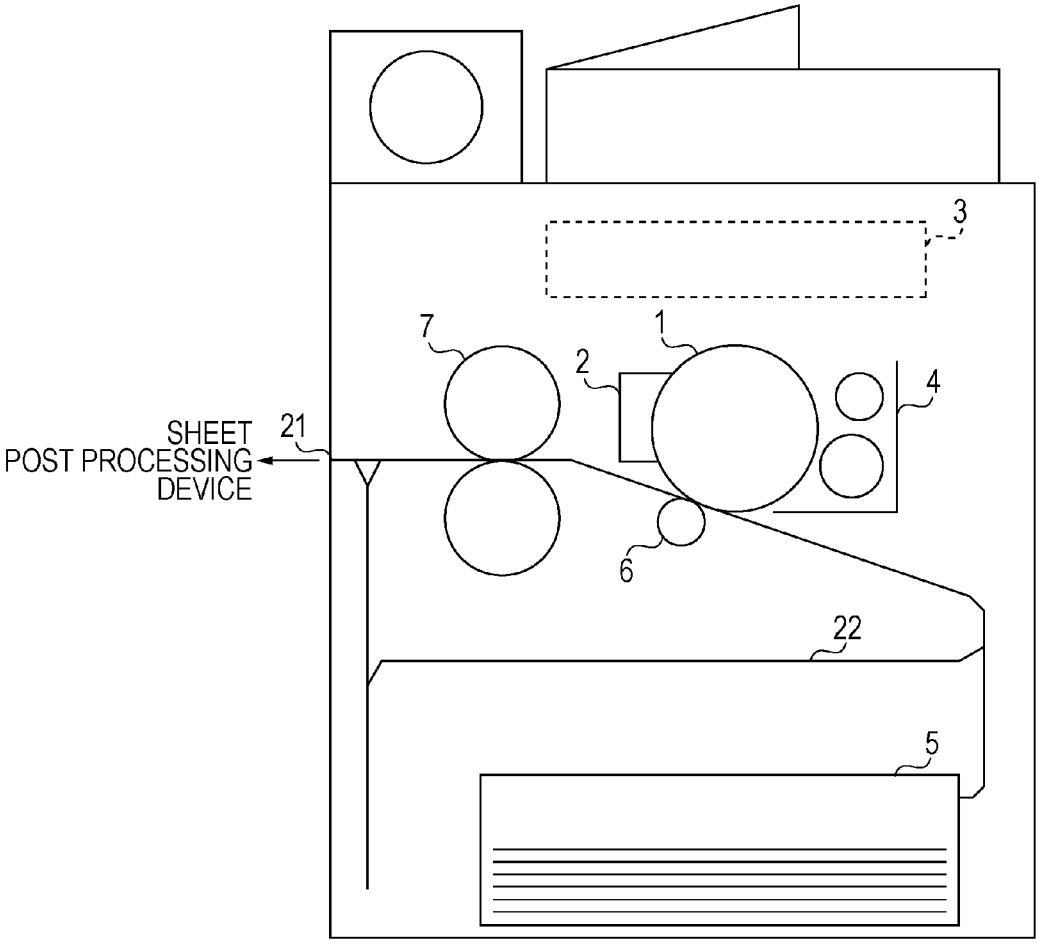
FIG. 1 is a cross-sectional view showing a brief configuration of an image forming apparatus.

FIG. 1 is a cross-sectional view briefly showing an image forming apparatus according to an embodiment of the present invention.

Referring to FIG. 1, a photosensitive drum 1 serving as an image bearing member is rotatably held. A corona charging unit 2, a laser exposure optical system 3, and a developing unit 4 are arranged around the photosensitive drum 1.

In the laser exposure optical system 3, a laser output unit converts an image signal from a document reading device into an optical signal, and a polygonal mirror (not shown) reflects laser light that is converted into the optical signal. The reflected laser light is projected on the surface of the photosensitive drum 1 through a lens (not shown) and reflection mirrors (not shown).

The photosensitive drum 1 is uniformly electrically charged by the charging unit 2, and then irradiated with the laser light. Hence, a latent image is formed on the photosensitive drum 1. The developing unit 4 develops the latent image on the photosensitive drum 1, thereby forming a toner image.

Sheets serving as recording media are fed from a housing unit 5 one by one, and a fed sheet is conveyed to a transferring unit 6 at a predetermined timing. The transferring unit 6 transfers the toner image on the photosensitive drum 1 to the sheet. A fixing unit 7 fixes the toner image to the sheet. Then, the sheet is discharged from a discharge port 21 to a sheet post processing device that is connected to the image forming apparatus. The fixing unit 7 has rollers that are constantly driven at 500 mm/s.

Figure 2:
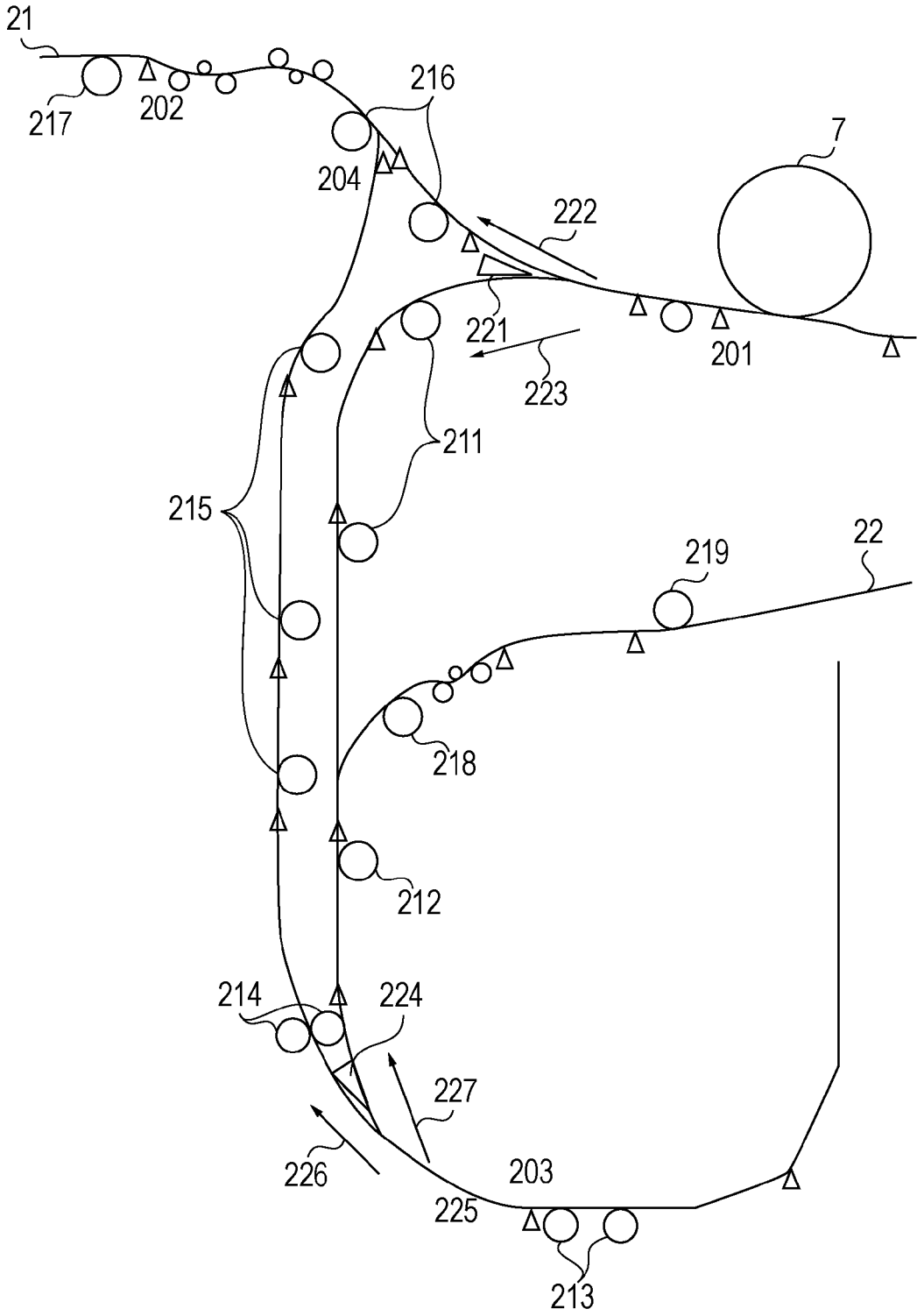
FIG. 2 is a configuration diagram showing a reversing unit of the image forming apparatus.

FIG. 2 illustrates in detail a section of the image forming apparatus in FIG. 1 located downstream of the fixing unit 7. A discharge sensor 201, a discharge sensor 202, a reverse sensor 203, and a convey sensor 204 detect the presence of a sheet. Each of the sensors 201 to 204 can detect that the leading edge of a sheet has reached the sensor position and that the trailing edge of the sheet has passed the sensor position. Conveying rollers 211, 212, and 214 to 219, and reversing rollers 213 are driven to convey a sheet in predetermined directions. In FIG. 2, rollers denoted by the same reference numeral are driven by the same motor. The conveying rollers 211 are driven to convey a sheet from the fixing unit 7 toward the reversing rollers 213. The conveying roller 212 is driven to convey the sheet from the conveying rollers 211 toward the reversing rollers 213, and driven in reverse manner to convey the sheet reversed by the reversing rollers 213 toward a duplex path 22. The reversing rollers 213 draw in the sheet conveyed from the conveying roller 212 and then rotate in reverse manner. The reversing rollers 213 have a function of conveying the sheet toward the duplex path 22, and a function of conveying the sheet toward the conveying rollers 214. The conveying rollers 214 and 215 convey the sheet from the reversing rollers 213 toward the discharge port 21. The conveying rollers 216 convey the sheet (a sheet to be discharged in non-reverse manner), which is directly conveyed from the fixing unit 7 not through the reversing rollers 213, and convey the sheet (a sheet to be discharged in reverse manner), which is from the conveying rollers 214 and 215 after the sheet passes through the reversing rollers 213, to the discharge port 21. The conveying roller 217 conveys the sheet from the discharge port 21 to the outside of the image forming apparatus. The conveying rollers 218 and 219 convey the sheet, which has been reversed by the reversing rollers 213 for duplex printing on the sheet, toward the duplex path 22.

The positions of flappers 221 and 224 are controlled so that the conveying direction of a sheet is changed. The position of the flapper 221 is switched between a position when a sheet, which has passed through the fixing unit 7, is conveyed in a reverse-duplex direction 223, and a position when a sheet is conveyed in a non-reverse discharge direction 222. The position of the flapper 224 is switched between a position when a sheet, which has been drawn into the reversing rollers 213, in a duplex direction 227, and a position when a sheet is conveyed in a reverse discharge direction 226.

The conveyance of a sheet will be described below with reference to FIG. 2. When a sheet is discharged from the image forming apparatus with an image-formed surface of the sheet facing the upper side (hereinafter, described as discharge in non-reverse manner), the flapper 221 is switched, so that the sheet is conveyed in the non-reverse discharge direction 222 after the sheet has passed through the fixing unit 7. Then, the sheet is discharged from the discharge port 21 through the conveying rollers 216 and 217 to the sheet post processing device located outside the image forming apparatus. To discharge the sheet in non-reverse manner, the conveying speed of the sheet is a second speed of 500 mm/s which is equivalent to a speed for image formation (a conveying speed of a sheet in the fixing unit 7).

When a sheet is discharged from the image forming apparatus with an image-formed surface of the sheet facing the lower side (hereinafter, described as discharge in reverse manner), the flapper 221 is switched, so that the sheet is conveyed in the reverse-duplex direction 223 after the sheet has passed through the fixing unit 7. Then, the sheet passes the rollers 211, 212, and 213, and is switched back at a reverse position 225. To discharge the sheet in reverse manner, the conveying speed of the sheet is increased to a first speed of 1000 mm/s, which is higher than the second speed of 500 mm/s for image formation, when the discharge sensor 201 detects that the trailing edge of the sheet has passed the discharge sensor 201. For the switchback, after the reverse sensor 203 has detected the leading edge of the sheet, the reversing rollers 213 are driven for a predetermined time corresponding to the length of the sheet. The reversing rollers 213 are stopped once, and then the reversing rollers 213 rotate in reverse manner. Accordingly, the sheet is conveyed in the opposite direction. The switched back sheet is conveyed in the reverse discharge direction 226 because the flapper 224 is switched. The sheet is discharged from the discharge port 21 through the conveying rollers 214, 215, and 216 to the sheet post processing device connected to the image forming apparatus. That is, the sheet is conveyed at the speed of 1000 mm/s until the sheet is discharged from the discharge port 21 after the trailing edge of the sheet passes through the fixing unit 7 and the sheet is switched back.

Next, image formation on both surfaces of a sheet will be described. The control for duplex printing is similar to the control in a case in which a sheet is discharged in reverse manner until a sheet is drawn into the reversing rollers 213. Then, the switched back sheet is conveyed in the duplex direction 227 because the flapper 224 is switched. The sheet is conveyed toward the duplex path 22 through the conveying rollers 212, 218, and 219. The sheet is conveyed to the duplex path 22 at 1000 mm/s. During duplex printing, the sheet conveyed to the duplex path 22 is conveyed to the transferring unit 6 and a toner image is transferred on the second surface in a manner similar to printing on the first surface of the sheet. The fixing unit 7 fixes the toner image. The sheet after duplex printing is discharged from the image forming apparatus such that the surface on which an image is formed last faces the upper side. Thus, the sheet passes through the same path as the path for non-reverse discharge, and is discharged to the sheet post processing device from the discharge port 21 at the current speed of 500 mm/s. Referring to FIG. 2, a conveying distance of a sheet when the sheet is discharged in reverse manner is larger than a conveying distance of a sheet when the sheet is discharged in non-reverse manner. Herein, the conveying distance is from passage of the sheet through the fixing unit 7 until discharge of the sheet to a sheet post processing device 350.

Figure 3:
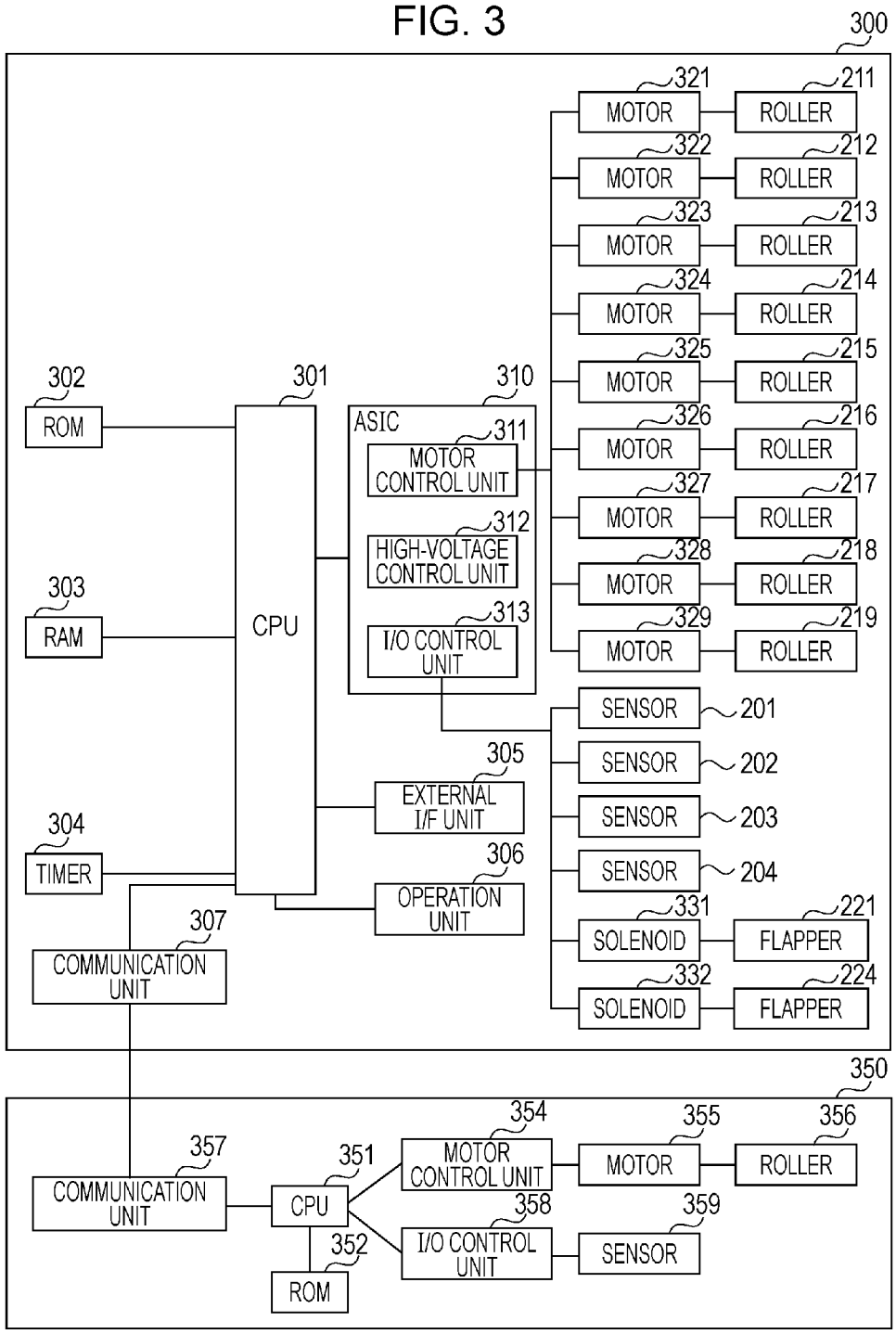
FIG. 3 is a block diagram showing a control configuration of the image forming apparatus.

FIG. 3 is a block diagram showing a brief control configuration of an image forming system according to this embodiment. An image forming apparatus 300 includes a CPU 301 that controls the entire image forming apparatus 300, a ROM 302 that stores a program and data required for the control, a RAM 303 that holds setting values and the like required for the control, a timer 304, and an external I/F unit 305 that communicates with an external device, such as a PC. The timer 304 sets a time required for the CPU 301 so that the CPU 301 counts a desirable time. When the timer 304 finishes counting the set time, the timer 304 transmits a time-up signal to the CPU 301. The image forming apparatus 300 further includes an operation unit 306 that receives the input from a user and displays information for the user, a communication unit 307 that communicates with the sheet post processing device 350, and an ASIC 310 that has a control function for respective components.

The ASIC 310 includes a motor control unit 311 that drives motors, a high-pressure control unit 312 that controls high voltages for developing, charging, transferring, etc., and an I/O control unit 313 that controls the inputs and outputs of respective sensors, etc.

The motor control unit 311 controls motors 321 to 329 that are used in the image forming apparatus. The rollers 211 to 219 are respectively connected to the motors 321 to 329. The motor control unit 311 controls the speeds and rotational directions of the motors 321 to 329, so as to control the speeds and rotational directions of the rollers 211 to 219.

The sensors 201 to 204 shown in FIG. 2 are connected to the I/O control unit 313. When sensor signals are changed, the change is notified to the CPU 301 through the I/O control unit 313. In addition, solenoids 331 and 332 that control the flappers 221 and 224 are connected to the I/O control unit 313. The I/O control unit 313 outputs a control signal on the basis of a command from the CPU 301, so as to control the flappers 221 and 224.

The sheet post processing device 350 includes a CPU 351 that controls the entire sheet post processing device 350, a ROM 352 that stores a program and data required for the control, an I/O control unit 358, a motor control unit 354, and a communication unit 357 that communicate with the communication unit 307 in the image forming apparatus 300.

The motor control unit 354 controls a motor 355 that is used in the sheet post processing device 350. A roller 356 is connected to the motor 355. The motor control unit 354 controls the speed and rotational direction of the motor 355 on the basis of a command from the CPU 351, so as to control the speed and rotational direction of the roller 356. The roller 356 receives a sheet discharged from the image forming apparatus 300. The motor control unit 354 can change the conveying speed of a sheet. When the sheet post processing device 350 receives a sheet that is discharged from the image forming apparatus 300, the motor control unit 354 controls the motor 355 such that the speed of the motor is equivalent to the discharging speed of the sheet from the image forming apparatus 300.

A sensor group 359 is connected to the I/O control unit 358. When signals from the sensors of the sensor group 359 are changed, the change is notified to the CPU 351 through the I/O control unit 358. The sensor group 359 includes a sensor that detects the presence of a sheet. This sensor is used for detection of sheet jam and conveyance control of a sheet. The detailed description of the sensor is omitted.

Figure 4:
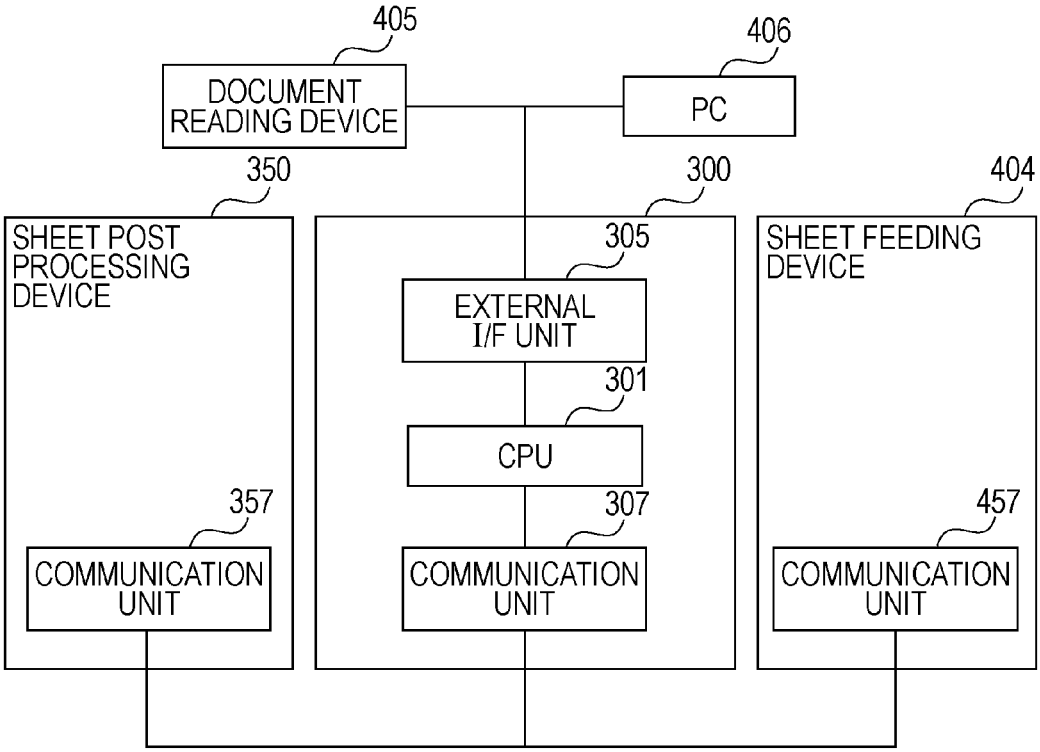
FIG. 4 is a configuration diagram showing an image forming system.

FIG. 4 illustrates the entire configuration of the image forming system. The image forming apparatus 300, the sheet post processing device 350, and a sheet feeding device 404 are connected with one another by serial communication lines through the communication units 307, 357, and 457. The sheet feeding device 404 feeds a sheet that is used for image formation to the image forming apparatus 300. A document reading device 405 that reads an image in a document, and a PC 406 serving as an external device are connected to the image forming apparatus 300 through the external I/F unit 305. The image forming apparatus 300 receives, for example, image data and data for print setting from the PC 406 and the document reading device 405, and transmits state information of the image forming apparatus 300, through the external I/F unit 305. Also, the image forming apparatus 300 notifies a sheet feeding command to the sheet feeding device 404 through the communication units 307 and 457, and notifies a sheet processing command to the sheet post processing device 350. Although FIG. 4 illustrates only a single sheet post processing device, a plurality of sheet post processing devices may be connected as desired. For example, the sheet post processing device to be connected may be a stacking device that stacks a large number of sheets, a gluing and binding device that binds sheets together by gluing, a folding device that binds sheets together by folding, and a finishing device that binds sheets by stapling.

Figure 5:
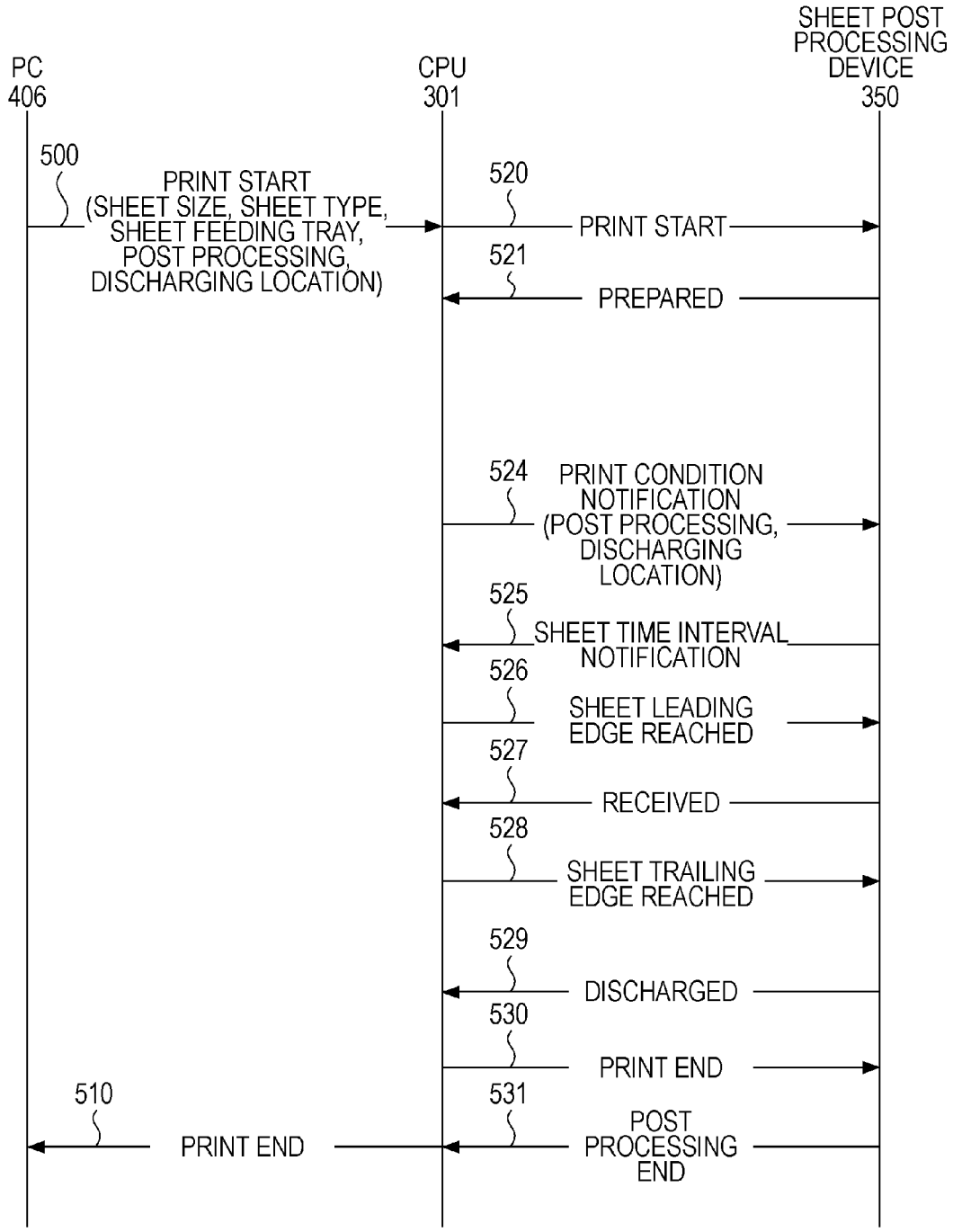
FIG. 5 illustrates a sequence of an image forming operation.

FIG. 5 illustrates transmission and reception of commands and data among the PC 406, the CPU 301, and the sheet post processing device 350, which is an external device, when a print job is carried out.

For example, when a cue for printing an image on a single page is transmitted from the PC 406 through the external I/F unit 305, a print start command 500 is notified from the PC 406 to the CPU 301. The print start command 500 includes the size and type of a sheet which is subjected to image formation, a sheet feeding tray from which a sheet is fed, designation of post processing, and designation of a sheet post processing device as a discharging location of the sheet. With the print start command 500, the CPU 301 acquires various pieces of information.

Next, when the CPU 301 receives the print start command 500, the CPU 301 transmits a print start command 520 to the sheet post processing device 350. The sheet post processing device 350 transmits a prepared command 521 to the CPU 301 when an operation of the sheet post processing device 350 has been prepared. When the CPU 301 receives the prepared command 521, the CPU 301 transmits a print condition notification command 524 to the sheet post processing device 350. The sheet post processing device 350 acquires the type of post processing, the discharging location, and the condition such as designation of reversing and duplex printing, on the basis of the print condition notification command 524. The sheet post processing device 350 transmits a sheet time interval notification command 525 to the CPU 301 to notify a sheet time interval required for processing.

The CPU 301 controls the timer 304 in accordance with the notified sheet time interval, to control the interval at which a sheet is discharged from the image forming apparatus 300. Also, the CPU 301 transmits a sheet leading edge reached command 526 to the sheet post processing device 350 at a timing immediately before the sheet reaches the sheet post processing device 350. In response to this, the sheet post processing device 350 transmits a received command 527 indicative of whether the sheet post processing device 350 has normally received the sheet, to the CPU 301.

Also, the CPU 301 transmits a sheet trailing edge reached command 528 to the sheet post processing device 350 at a timing immediately before the trailing edge of the sheet is discharged to the sheet post processing device 350. In response to this, the sheet post processing device 350 transmits a discharged command 529 indicative of whether the sheet has been normally discharged, to the CPU 301. Then, the CPU 301 determines that all images have been printed, and notifies a print end command 530 to the sheet post processing device 350. The CPU 301 receives a post processing end command 531 from the sheet post processing device 350, and transmits a print end command 510 to the PC 406 at a timing when stop processing in the image forming apparatus 300 has been ended. Then, the print job is ended.

FIG. 6 illustrates the content of an image forming job. For example, a job A includes duplex printing for images on the first and second pages, one-side printing for an image on the third page, duplex printing for images on the fourth and fifth pages, and one-side printing for an image on the sixth page when A4-size sheets are used for all pages.

A job B includes one-side printing on the first page, duplex printing on the second and third pages, one-side printing on the fourth page, and duplex printing on the fifth and sixth pages when A4-size sheets are used for all pages.

A job C includes one-side printing on the first page of a A4-size sheet, duplex printing on the second and third pages of A3-size sheets, one-side printing on the fourth page of a A4-size sheet, and duplex printing on the fifth and sixth pages of A4-size sheets.

The above setting is input from the PC 406 through the external I/F unit 305 to the image forming apparatus 300, or designated by the operation unit 306.

Figure 7:
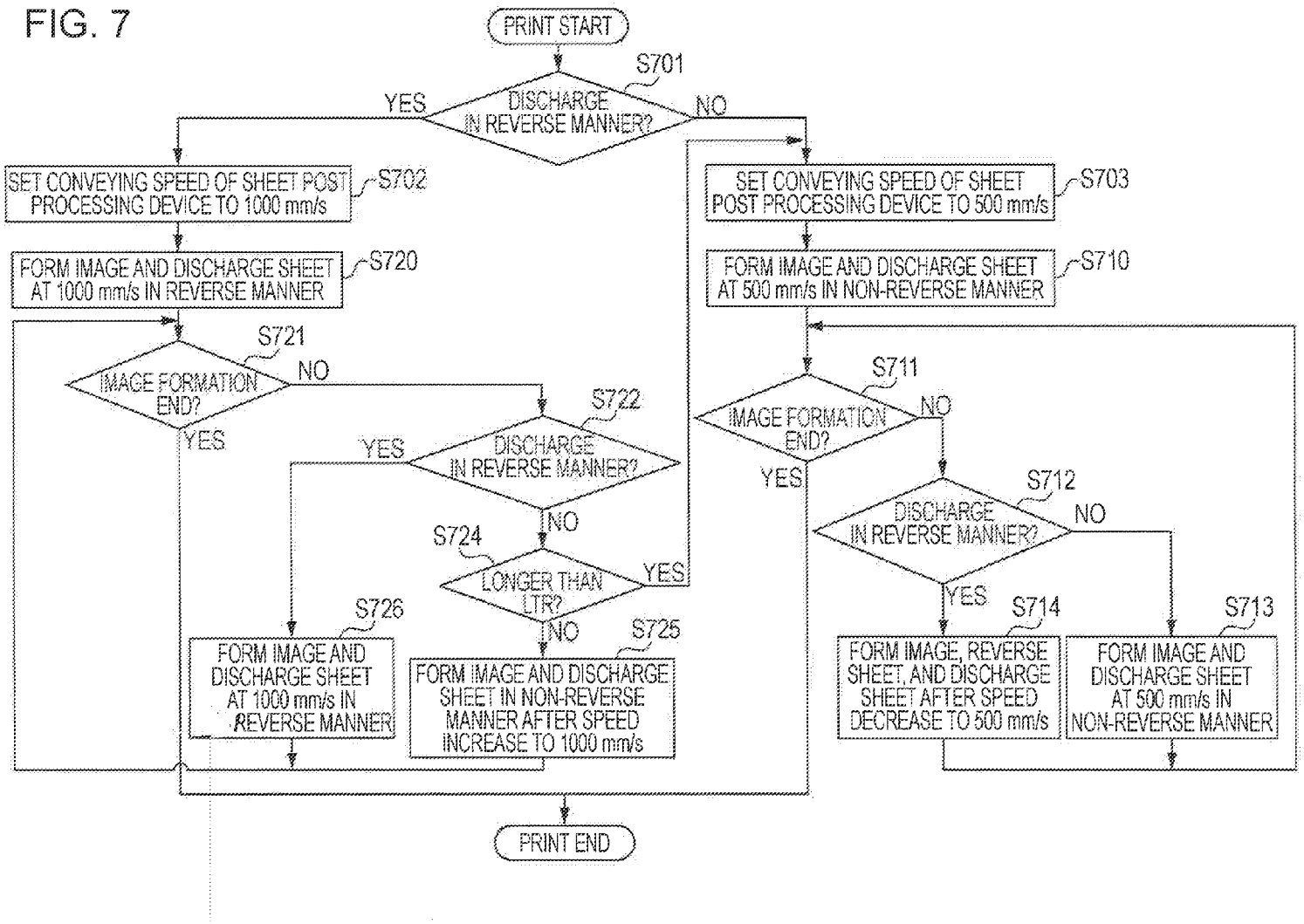
FIG. 7 is a flowchart showing control for determining a discharging speed of a sheet.

FIG. 7 is a flowchart showing control for determining the discharging speed of a sheet. This flowchart is executed by the CPU 301. When printing is started, the CPU 301 analyzes the received print start command 500, and determines whether the first sheet is to be discharged in reverse manner (S701). If the sheet is to be discharged in reverse manner, the CPU 301 transmits the print condition notification command 524 to the sheet post processing device 350 so as to set the conveying speed in the sheet post processing device 350 to 1000 mm/s (S702). In contrast, if the sheet is to be discharged in non-reverse manner, the CPU 301 transmits the print condition notification command 524 to the sheet post processing device 350 so as to set the conveying speed in the sheet post processing device 350 to 500 mm/s (S703). The print condition notification command 524 is transmitted to the sheet post processing device 350 through the communication unit 307. When the sheet post processing device 350 receives the print condition notification command 524, the sheet post processing device 350 sets the conveying speed on the basis of the command.

The control for setting the conveying speed to 500 mm/s in step S703 will be described.

The CPU 301 causes an image to be formed on a sheet, and causes the image-formed sheet to be conveyed through the path, in which a sheet is discharged to the sheet post processing device 350 in non-reverse manner as described with reference to FIG. 2, at the conveying speed of 500 mm/s (S710).

The CPU 301 determines whether the next sheet for image formation is present (or whether image formation is ended, S711). If the next sheet is present (or if image formation is not ended, that is, No in step S711), it is determined whether the next sheet is to be discharged in reverse manner (S712), like step S701. If the sheet is to be discharged in non-reverse manner (if No in step S712), the CPU 301 causes an image to be formed on the sheet, and causes the image-formed sheet to be conveyed through the path, in which the sheet is discharged to the sheet post processing device 350 in non-reverse manner, at the conveying speed of 500 mm/s (S713), like step S710. If the sheet is determined to be discharged in reverse manner in step S712, the CPU 301 causes an image to be formed on the sheet, and causes the sheet to be discharged at the conveying speed of 500 mm/s, which is equivalent to the speed of the previous sheet (S714). Normally, a sheet is discharged in reverse manner at the conveying speed of 1000 mm/s, however, the CPU 301 controls such that the sheet is discharged by decreasing the conveying speed to 500 mm/s, which is equivalent to the discharging speed of the previous sheet, so as to decrease the frequency of changing the conveying speed of the sheet post processing device 350. Thereafter, the control from step S711 is repeated until the image formation is ended.

Figure 8:
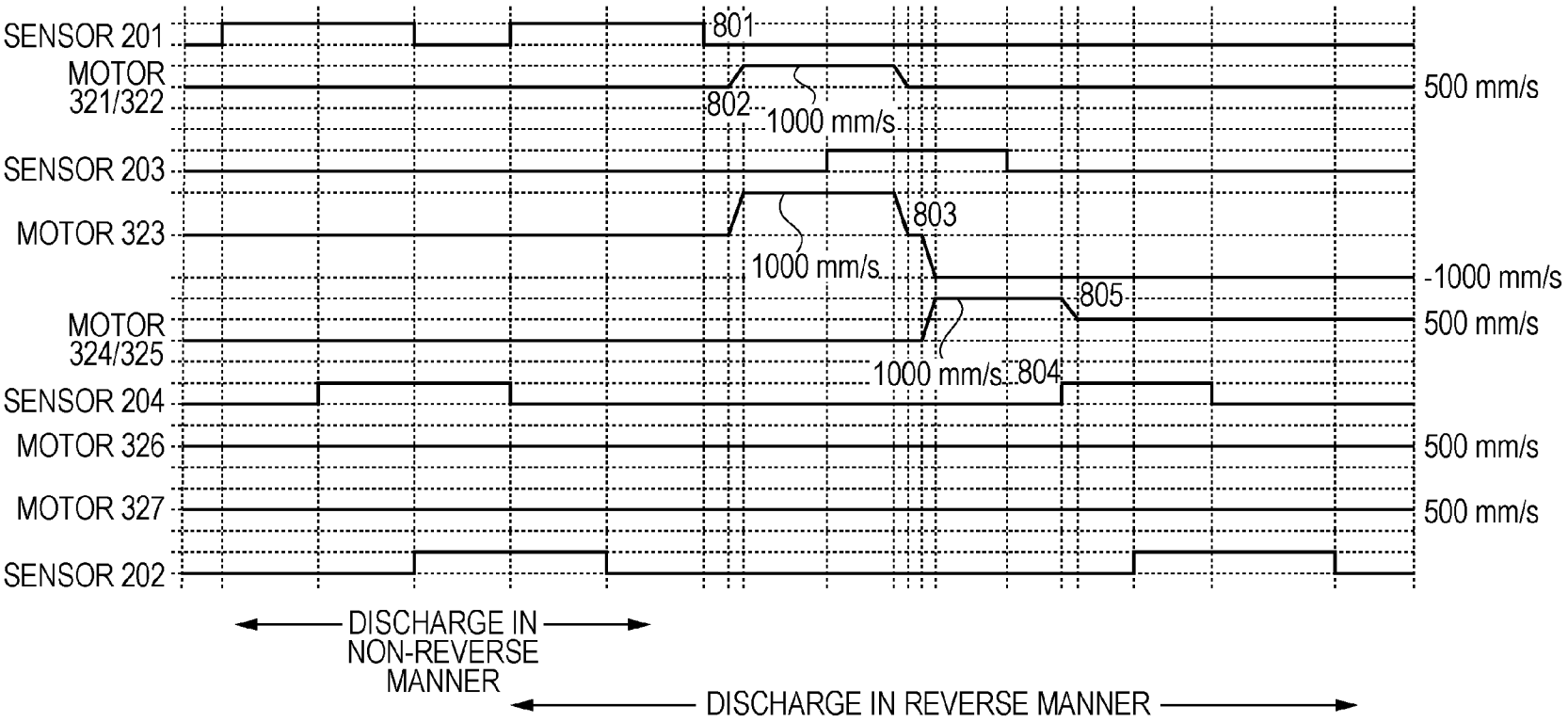
FIG. 8 is a timing chart relating to discharging control for a sheet.

The discharging operation will be described with reference to a timing chart in FIG. 8. FIG. 8 illustrates the detection states of the respective sensors and the speeds of the respective motors when the first sheet is subjected to duplex printing and the second sheet is subjected to one-side printing. After an image is formed on the second surface of the first sheet, the first sheet is discharged in non-reverse manner. At this time, the motors 326 and 327 are operated at 500 mm/s, which is equivalent to the speed of image formation. The first sheet is discharged in non-reverse manner. After an image is formed on the second sheet, and when the discharge sensor 201 detects the leading edge of the second sheet, the flapper 221 is switched, and the second sheet is conveyed in the reverse discharge direction 223. When the discharge sensor 201 detects the trailing edge of the second sheet (timing 801), the conveying speed of the motors 321 and 322 is increased from 500 mm/s to 1000 mm/s, and the motor 323 is driven at the conveying speed of 1000 mm/s (timing 802). Consequently, the conveying speed of the rollers 211, 212, and 213 becomes 1000 mm/s. When a predetermined time has elapsed after the reverse sensor 203 detects the leading edge of the second sheet, the motor 323 is rotated in reverse manner, and the motors 324 and 325 are driven (timing 803). The speed of the motors 323, 324, and 325 at this time is 1000 mm/s. Consequently, the second sheet is switched back, and the front and back surfaces of the sheet are reversed. For the convenience of description, the conveying speed of a sheet may be occasionally represented by the speed of a motor.

When a required time from when the sensor 203 detects the leading edge of the second sheet until passage of the trailing edge of the sheet through the flapper 224 has elapsed, the solenoid 332 switches the flapper 224, and hence the second sheet is conveyed in the reverse discharge direction 226. Then, the second sheet is conveyed through the conveying rollers 214 and 215. When the convey sensor 204 detects the leading edge of the second sheet (timing 804), the speed of the motors 324 and 325 is decreased, and hence the conveying speed by the conveying rollers 214 and 215 is decreased to 500 mm/s (timing 805).

The second sheet is discharged from the discharge port 21 to the sheet post processing device 350 by the conveying rollers 216 and 217. The conveying speed by the conveying rollers 216 and 217 at this time is 500 mm/s, which is equivalent to the speed of the previously conveyed first sheet. That is, the sheet post processing device 350 can receive the first and second sheets at the equivalent conveying speeds. Thus, the frequency of changing the speed can be decreased.

The third and later sheets are also identified as a sheet to be discharged in reverse manner or a sheet to be discharged in non-reverse manner, on the basis of the content of the print start command 500 until image formation is ended. Consequently, control for discharging a sheet through the non-reverse path at 500 mm/s (S713) and control for conveying a sheet through the reverse path at the increased speed of 1000 mm/s and then discharging the sheet at the decreased speed of 500 mm/s (S714) is selectively executed.

Figure 10A:
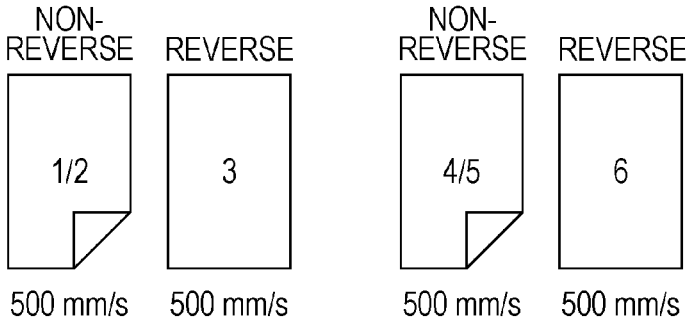
FIGS. 10A to 10C illustrate operations when sheets to be discharged in reverse manner and sheets to be discharged in non-reverse manner are mixed.

FIG. 10A briefly illustrates the discharge states of the sheets when the job A shown in FIG. 4 is carried out. When the first sheet is discharged to the sheet post processing device at 500 mm/s, the second sheet is discharged at the discharging speed equivalent to the speed of the previous sheet even if the second sheet should be discharged in reverse manner at 1000 mm/s. The third and later sheets are discharged at the discharging speed equivalent to the speed of the previous sheet. As a result, the conveying speed of the sheet post processing device does not have to be changed and is held at 500 mm/s. The decrease in productivity due to changing of the conveying speed of the sheet post processing device can be prevented.

Next, the control for setting the conveying speed to 1000 mm/s in step S702 will be described. The CPU 301 causes an image to be formed on a sheet, causes the sheet to be conveyed through the path described in FIG. 2, and causes the sheet to be discharged to the sheet post processing device 350 at the conveying speed of 1000 mm/s (S720). The CPU 301 determines whether the next sheet for image formation is present (or whether image formation is ended, S721). If the next sheet is present (or if image formation is not ended, that is, No in step S721), it is determined whether the next sheet is to be discharged in reverse manner (S722), like step S701. If the next sheet is to be discharged in reverse manner, the CPU 301 causes the sheet to be conveyed through the same path as in step S720, and causes the sheet to be discharged to the sheet post processing device 350 at the conveying speed of 1000 mm/s (S726).

In contrast, if the next sheet is to be discharged in non-reverse manner in step S722, the CPU 301 determines whether the size of the sheet is the letter size (LTR) or smaller on the basis of the information in the print start command 500 (S724). The image forming apparatus 300 of this embodiment has a configuration in which a distance between the fixing unit 7 and the conveying roller 217 is about 230 mm. That is, when the length of the sheet in the conveying direction is 230 mm or larger, the sheet is conveyed such that the leading edge of the sheet enters the sheet post processing device 350 before the trailing edge of the sheet passes through the fixing unit 7. That is, when the sheet with the length of 230 mm or larger is conveyed through the non-reverse discharge path, the conveying speed of the sheet cannot be increased from 500 mm/s to 1000 mm/s until the leading edge of the sheet is discharged to the sheet post processing device 350. Owing to this, in this embodiment, a predetermined size serving as a threshold is the LTR size. Thus, when the sheet post processing device 350 has conveyed the previous sheet at 1000 mm/s, and if the length of the next sheet is larger than the LTR size and the sheet is to be discharged in non-reverse manner, the print condition notification command 524 is transmitted to the sheet post processing device 350 through the communication unit 307. That is, the CPU 301 causes the conveying speed of the sheet post processing device 350 to be changed to 500 mm/s (S703). The control after the conveying speed of the sheet post processing device 350 is changed to 500 mm/s is similar to the control from step S710.

If the next sheet is to be discharged in non-reverse manner in step S722, and if the sheet has a size equal to or smaller than the LTR size in step S724, the CPU 301 causes an image to be formed on the sheet, and causes the sheet to be discharged in non-reverse manner at the conveying speed of 1000 mm/s (S725). This control will be described with reference to a timing chart in FIG. 9.

Figure 9:
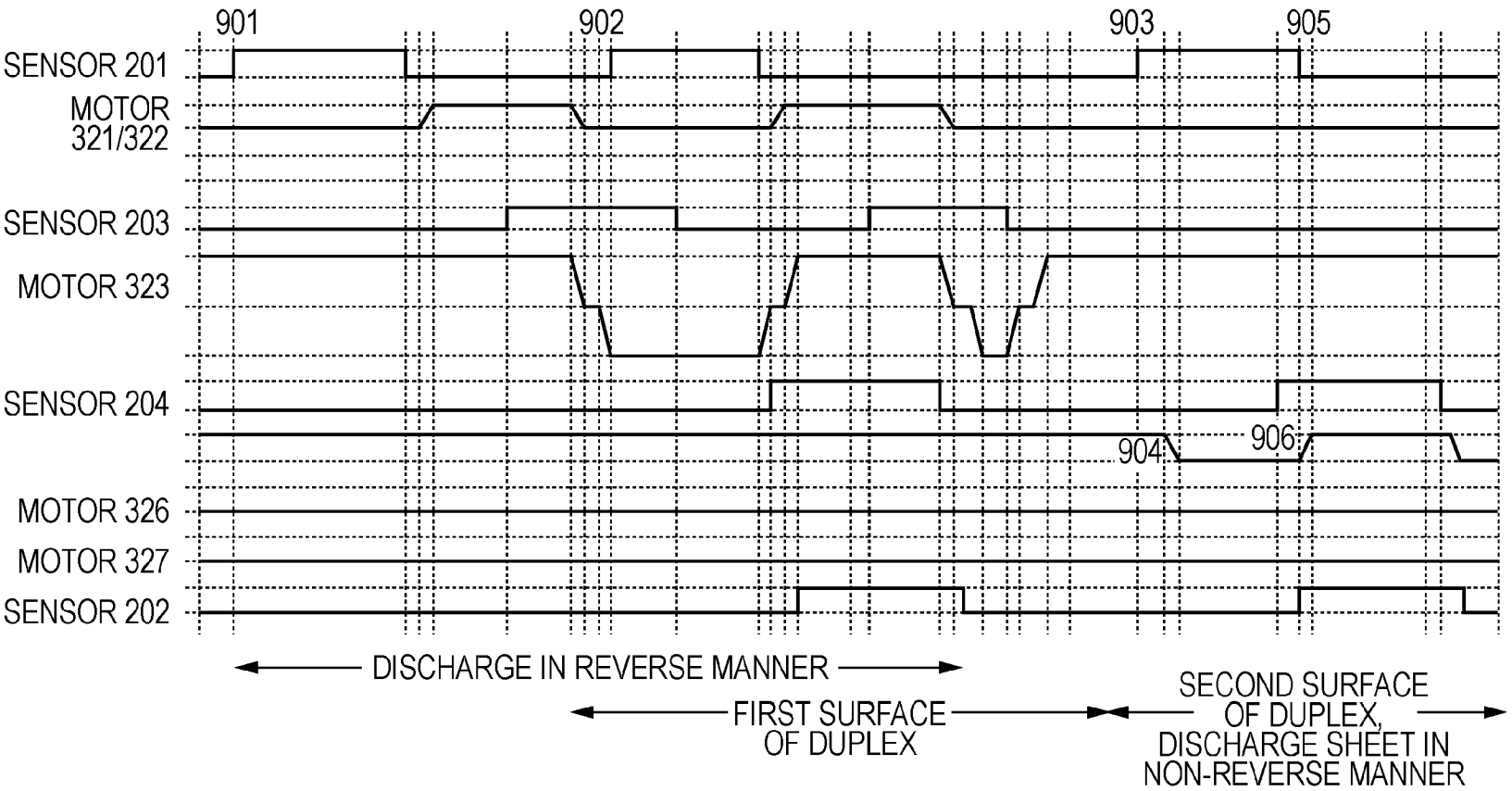
FIG. 9 is a timing chart relating to discharging control for a sheet.

FIG. 9 illustrates the detection states of the respective sensors and the speeds of the respective motors when the first sheet is subjected to one-side printing and the second sheet is subjected to duplex printing. At an illustrated timing 901, the discharge sensor 201 detects the leading edge of the first sheet. At a timing 902, the discharge sensor 201 detects the leading edge of the second sheet after an image is formed on the first surface (front surface) of the second sheet. At a timing 903, the discharge sensor 201 detects the leading edge of the second sheet after an image is formed on the second surface (back surface) of the second sheet. After the image-formed first sheet passes through the fixing unit 7, and when a predetermined time has elapsed after the discharge sensor 201 detects the trailing edge of the first sheet, the motors 321 and 322 are driven at the increased speed of 1000 mm/s, and the first sheet is conveyed to the reverse position 225 by the conveying rollers 211 and 212. Then, when a predetermined time has elapsed after the reverse sensor 203 detects the leading edge of the first sheet, the motor 323 is rotated in reverse manner, the first sheet is switched back, and the front and back surfaces of the first sheet are reversed. The first sheet is conveyed by the conveying rollers 214, 215, 216, and 217 at 1000 mm/s, and the first sheet is discharged to the sheet post processing device 350. An image is formed on the first surface of the second sheet. Then, the second sheet is conveyed to the duplex path 22 through the reverse path, and an image is formed on the second surface.

When the discharge sensor 201 detects the leading edge of the second sheet after the image is formed on the second surface of the second sheet (timing 903), the flapper 221 is switched, and the second sheet is conveyed in the non-reverse discharge direction 222. When a predetermined time has elapsed after the discharge sensor 201 detects the leading edge of the second sheet, the conveying speed by the motor 326 is decreased to 500 mm/s (timing 904). The predetermined time is set in the timer 304 by the CPU 301. Then, when the discharge sensor 201 detects the trailing edge of the second sheet (timing 905), the conveying speed of the conveying rollers 216 by the motor 326 is increased again to 1000 mm/s (timing 906).

The second sheet is discharged from the discharge port 21 to the sheet post processing device 350 through the conveying roller 217. While the second sheet is discharged, the conveying speed of the conveying roller 217 by the motor 327 is held at 1000 mm/s, which is equivalent to the conveying speed of the previous sheet. That is, the sheet post processing device 350 can receive the first and second sheets at the equivalent conveying speeds. Thus, the frequency of changing the speed can be decreased.

The third and later sheets are also identified as a sheet to be discharged in reverse manner or a sheet to be discharged in non-reverse manner, on the basis of the content of the print start command 500 until image formation is ended. As a result, control for discharging a sheet in reverse manner at 1000 mm/s (S726), control for discharging a sheet in non-reverse manner at the increased conveying speed of 1000 mm/s (S725), and control for changing the conveying speed of the sheet post processing device 350 to 500 mm/s (S703) can be selectively executed.

When the print job is ended and then a new print job is input, the control is executed again from step S701. However, if the next print job has been already input, and the next print job can be continuously executed, the discharging speed of the first sheet in the next print job is controlled to be equivalent to the discharging speed of the last sheet in the previous print job.

Figure 10B:
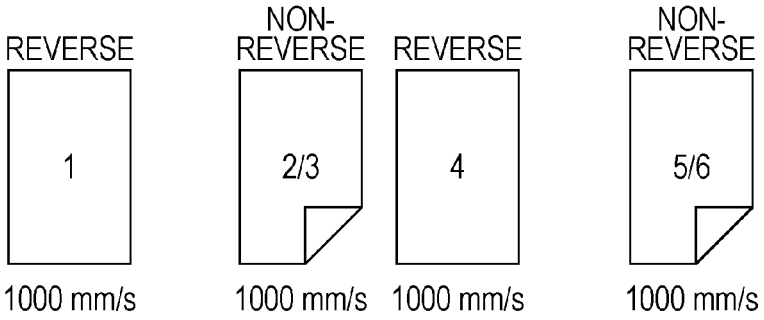

FIG. 10B briefly illustrates the discharge states of the sheets when the job B shown in FIG. 4 is carried out. When the first sheet is discharged to the sheet post processing device at 1000 mm/s, the second sheet is discharged at the discharging speed equivalent to the speed of the previous sheet even if the second sheet should be discharged in non-reverse manner at 500 mm/s as long as the sheet has the predetermined size (LTR) or smaller. The third and later sheets are discharged at the discharging speed equivalent to the speed of the previous sheet as long as the sheets have the predetermined size (LTR) or smaller. As a result, the conveying speed of the sheet post processing device does not have to be changed and is held at 1000 mm/s. Thus, the decrease in productivity due to changing of the conveying speed of the sheet post processing device can be prevented.

Figure 10C:
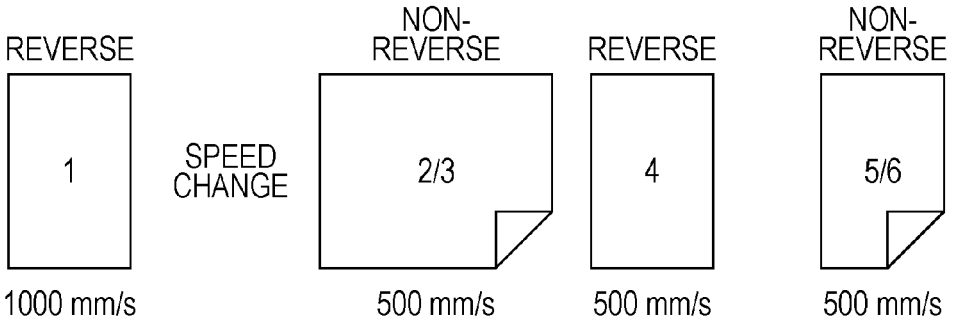
Figure 11:
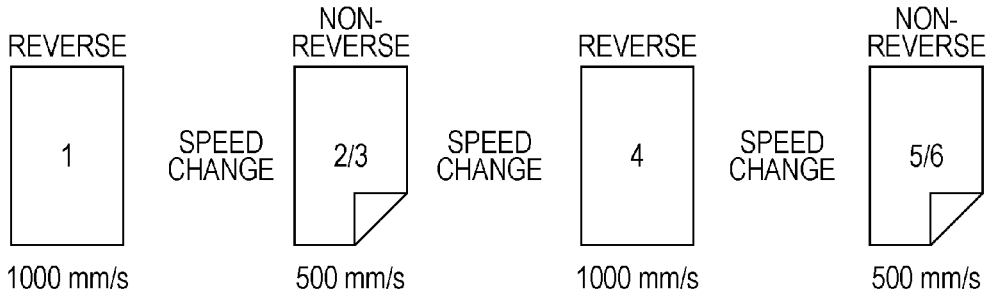
FIG. 11 illustrates an operation when sheets to be discharged in reverse manner and sheets to be discharged in non-reverse manner are mixed.

FIG. 10C briefly illustrates the discharge states of the sheets when the job C shown in FIG. 4 is carried out. The discharging speed of a sheet having a size larger than the predetermined size (LTR) is 500 mm/s. Although a sheet which should be discharged at 1000 mm/s is mixed thereafter, the sheet is discharged at the discharging speed equivalent to the speed of the previous sheet. The third and later sheets are discharged at the discharging speed equivalent to the speed of the previous sheet. As a result, changing of the speed of the sheet post processing device is only once. As compared with related art, the decrease in productivity due to changing the speed of the sheet post processing device can be reduced.

The image forming apparatus 300 uses a motor that originally has high responsiveness to the change in speed so as to provide uniform productivity when a sheet is discharged in reverse manner and when a sheet is discharged in non-reverse manner, even with regard to a case in which the image forming apparatus is used without the sheet post processing device. Also, the conveying rollers are arranged with regard to changing of the speed. Thus, as described above in the embodiment, even when the control for discharging a sheet, which is to be discharged in reverse manner, by decreasing the speed, and the control for discharging a sheet, which is to be discharged in non-reverse manner, by increasing the speed, are carried out, the speed can be changed without the cost is additionally increased.

If the sheet post processing device is not connected to the image forming apparatus 300, changing of the speed of the sheet post processing device does not have to be considered. Thus, the image forming apparatus 300 discharges a sheet to be discharged in reverse manner at 1000 mm/s, and discharges a sheet to be discharged in non-reverse manner at 500 mm/s regardless of the discharging speed of the previous sheet.

If the sheet post processing device 350 according to this embodiment does not carry out post processing for a sheet but conveys the sheet to another sheet post processing device connected to the downstream side of the sheet post processing device 350, the sheet post processing device 350 may convey the sheet at 1000 mm/s. However, if a gluing and binding device is connected to the sheet post processing device 350 on the downstream side, the sheet has to be conveyed at 500 mm/s to improve registration of sheets on a tray for housing sheets to be bound. Therefore, in a print job in which binding is designated, the CPU 301 transmits the pint condition notification command 524 to the sheet post processing device 350 through the communication unit 307, so that the conveying speed of the sheet post processing device 350 is changed to 500 mm/s. The sheets subjected to binding are determined on the basis of the content of the pint condition notification command 504. The control after the conveying speed of the sheet post processing device 350 is changed to 500 mm/s is similar to the control from step S710.

As described above, since the next sheet is discharged at the discharging speed equivalent to the discharging speed of the previous sheet, the frequency of changing the conveying speed of the sheet post processing device can be decreased, and hence, the decrease in productivity can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-067904 filed Mar. 19, 2009, which is hereby incorporated by reference herein in its entirety.

What is claimed is:

1. An image forming apparatus which is connectable to a sheet post processing device capable of changing a conveying speed when the sheet post processing device receives a sheet, the image forming apparatus comprising:

an image forming unit configured to form an image on a sheet based on an input print job;

a reversing unit configured to reverse front and back surfaces of a sheet on which an image is formed;

a discharging unit configured to discharge a sheet in one of a reverse discharge mode and a non-reverse discharge mode, wherein the reverse discharge mode is a mode for discharging a sheet after front and back surfaces of the sheet are reversed by the reversing unit, and the non-reverse discharge mode is a mode for discharging a sheet, front and back surfaces of which are not reversed; and a control unit configured to control the discharging unit, while the image forming apparatus is not connected to the sheet post processing device, to discharge a sheet at a first speed in response to the sheet being discharged in the reverse discharge mode and to discharge a sheet at a second speed lower than the first speed in response to the sheet being discharged in the non-reverse discharge mode, and configured to control the discharging unit, while the image forming apparatus is connected to the sheet post processing device, to discharge a subsequent sheet, immediately subsequent to a previous sheet, at the first speed in the non-reverse discharge mode to the sheet post processing device in response to the previous sheet being discharged at the first speed and the subsequent sheet being discharged in the non-reverse discharge mode, and to discharge the subsequent sheet at the second speed in the reverse discharge mode to the sheet post processing device in response to the previous sheet being discharged at the second speed and the subsequent sheet being discharged in the reverse discharge mode.

2. The image forming apparatus according to claim 1, wherein, in response to a first sheet in the print job being discharged to the sheet post processing device in the reverse discharge mode, the control unit controls the discharging unit to discharge the first sheet at the first speed, and in response to the first sheet in the print job being discharged to the sheet post processing device in the non-reverse discharge mode, the control unit controls the discharging unit to discharge the first sheet at the second speed.

3. The image forming apparatus according to claim 1, wherein a sheet on which an image is formed in a one-side image forming mode is discharged in the reverse discharge mode, and a sheet on which an image is formed in a duplex image forming mode is discharged in the non-reverse discharge mode.

4. The image forming apparatus according to claim 1, wherein, when a first print job and a second print job immediately following the first print job are executed continuously, the control unit controls the discharging unit to discharge a first sheet in the second print job at a speed equal to a speed at which a last sheet in the first print job is discharged.

5. The image forming apparatus according to claim 1, further comprising a fixing unit configured to fix an image formed on the sheet, wherein a conveying distance of the sheet from passage of the sheet through the fixing unit until discharge of the sheet to the sheet post processing device when the sheet is to be discharged in the reverse discharge mode is longer than a conveying distance of a sheet from passage of the sheet through the fixing unit until discharge of the sheet to the sheet post processing device when the sheet is to be discharged in the non-reverse discharge mode.

6. The image forming apparatus according to claim 1, wherein, in a case where a sheet is to be discharged to the sheet post processing device at the second speed in the reverse discharge mode, the control unit controls the reversing unit to decelerate the sheet from a higher speed than the second speed to the second speed and to discharge the sheet.

7. An image forming apparatus which is connectable to a sheet post processing device capable of changing a conveying speed when the sheet post processing device receives a sheet, the image forming apparatus comprising:

an image forming unit configured to form an image on a sheet based on an input print job;

a reversing unit configured to reverse front and back surfaces of a sheet on which an image is formed;

a discharging unit configured to discharge a sheet in one of a reverse discharge mode and a non-reverse discharge mode, wherein the reverse discharge mode is a mode for discharging a sheet after front and back surfaces of the sheet are reversed by the reversing unit, and the non-reverse discharge mode is a mode for discharging a sheet, front and back surfaces of which are not reversed; and a control unit configured to control the discharging unit, while the image forming apparatus is not connected to the sheet post processing device, to discharge a sheet at a first speed in response to the sheet being discharged in the reverse discharge mode and to discharge a sheet at a second speed lower than the first speed in response to the sheet being discharged in the non-reverse discharge mode, and controls the discharging unit, while the image forming apparatus is connected to the sheet post processing device, to discharge a subsequent sheet, immediately subsequent to a previous sheet, at the first speed in the non-reverse discharge mode to the sheet post processing device in response to the previous sheet being discharged at the first speed and the subsequent sheet being discharged in the non-reverse discharge mode and having a length equal to or less than a predetermined length in a conveying direction, and to discharge the subsequent sheet at the second speed in the non-reverse discharge mode to the sheet post processing device in response to the subsequent sheet being discharged in the non-reverse discharge mode and having a length greater than the predetermined length, and to discharge the subsequent sheet at the second speed in the reverse discharge mode to the sheet post processing device in response to the previous sheet being discharged at the second speed and the subsequent sheet being discharged in the reverse discharge mode.

8. An image forming apparatus connected to a sheet post processing device capable of changing a conveying speed when the sheet post processing device receives a sheet, the image forming apparatus comprising:

an image forming unit configured to form an image on a sheet based on an input print job;

a reversing unit configured to reverse front and back surfaces of a sheet on which an image is formed;

a discharging unit configured to discharge a sheet in one of a reverse discharge mode and a non-reverse discharge mode, wherein the reverse discharge mode is a mode for discharging a sheet after front and back surfaces of the sheet are reversed by the reversing unit, and the non-reverse discharge mode is a mode for discharging a sheet, front and back surfaces of which are not reversed; and a control unit configured to control the discharging unit to discharge a first sheet in a print job at a first speed in response to the first sheet being discharged in the reverse discharge mode and to discharge the first sheet at a second speed lower than the first speed in response to the first sheet being discharged in the non-reverse discharge mode, wherein, in response to the first sheet being discharged at the first speed, the control unit controls the discharging unit to discharge a second sheet in the print job that is being discharged in the non-reverse discharge mode at the first speed in the non-reverse discharge mode, and in response to the first sheet being discharged at the second speed, the control unit controls the discharging unit to discharge a second sheet in the print job that is being discharged in the reverse discharge mode at the second speed in the reverse discharge mode.

9. The image forming apparatus according to claim 8, further comprising a fixing unit configured to fix an image formed on the sheet, wherein a conveying distance of the sheet from passage of the sheet through the fixing unit until discharge of the sheet to the sheet post processing device in the reverse discharge mode is longer than a conveying distance of a sheet from passage of the sheet through the fixing unit until discharge of the sheet to the sheet post processing device in the non-reverse discharge mode.

10. The image forming apparatus according to claim 8, wherein, in a case where a sheet is to be discharged to the sheet post processing device at the second speed in the reverse discharge mode, the control unit controls the reversing unit to decelerate the sheet from a higher speed than the second speed to the second speed and to discharge the sheet.

11. An image forming apparatus connected to a sheet post processing device capable of changing a conveying speed when the sheet post processing device receives a sheet, the image forming apparatus comprising:

an image forming unit configured to form an image on a sheet based on an input print job;

a reversing unit configured to reverse front and back surfaces of a sheet on which an image is formed;

a discharging unit configured to discharge a sheet in one of a reverse discharge mode and a non-reverse discharge mode, wherein the reverse discharge mode is a mode for discharging a sheet after front and back surfaces of the sheet are reversed by the reversing unit, and the non-reverse discharge mode is a mode for discharging a sheet, front and back surfaces of which are not reversed; and a control unit configured to control the discharging unit to discharge a first sheet in a print job at a first speed in response to the first sheet being discharged in the reverse discharge mode and to discharge the first sheet at a second speed lower than the first speed in response to the first sheet being discharged in the non-reverse discharge mode, wherein, in response to the first sheet being discharged at the first speed and a second sheet in the print job that is being discharged in the non-reverse discharge mode and not having a length greater than a predetermined length in a conveying direction, the control unit controls the discharging unit to discharge the second sheet at the first speed in the non-reverse discharge mode, and in response to the first sheet being discharged at the first speed and a second sheet in the print job that is being discharged in the non-reverse discharge mode and having a length greater than a predetermined length in a conveying direction, the control unit controls the discharging unit to discharge the second sheet in the print job at the second speed, wherein, in response to the first sheet being discharged at the second speed and a second sheet in the print job that is being discharged in the reverse discharge mode, the control unit controls the discharging unit to discharge the second sheet in the print job at the second speed.

* * * * *